US009441368B2

(12) United States Patent
Kelly

(10) Patent No.: US 9,441,368 B2
(45) **Date of Patent: *Sep. 13, 2016**

(54) CONSTRUCTION SYSTEM FOR RELEASING MOISTURE FROM A HIP, VALLEY OR GABLE ROOF

(71) Applicant: WICKRIGHT, INC., Deerfield, IL (US)

(72) Inventor: Robert Kelly, Deerfield, IL (US)

(73) Assignee: WICKRIGHT, INC., Deerfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/574,458

(22) Filed: Dec. 18, 2014

(65) Prior Publication Data

US 2015/0292205 A1 Oct. 15, 2015

(51) Int. Cl.

| | |
|---|---|
| ***E04B 7/02*** | (2006.01) |
| ***E04B 7/18*** | (2006.01) |
| ***E04D 13/17*** | (2006.01) |
| ***E04D 13/04*** | (2006.01) |
| ***E04D 13/064*** | (2006.01) |
| ***E04D 13/072*** | (2006.01) |

(52) U.S. Cl.

CPC . *E04B 7/18* (2013.01); *E04B 7/02* (2013.01); *E04D 13/04* (2013.01); *E04D 13/064* (2013.01); *E04D 13/072* (2013.01); *E04D 13/17* (2013.01); *E04D 13/174* (2013.01); *E04D 13/178* (2013.01)

(58) Field of Classification Search

CPC ... E04D 13/00; E04D 13/0325; E04D 13/04; E04D 13/0459; E04D 13/152; E04D 13/155; E04D 13/1585; E04D 13/143; E04D 13/147; E04D 13/1471; E04D 13/1473; E04D 13/1475; E04D 13/17; E04D 13/172; E04D 13/174; E04D 13/176; E04D 13/178; E04D 13/16; E04D 13/1618; E04D 2013/0893; F24F 2007/003; F24F 2007/0047; F24F 7/02; F24F 7/04; E04B 7/18; E04B 7/02; E04B 7/00; E04B 7/026

See application file for complete search history.

(56) References Cited

U.S. PATENT DOCUMENTS

| | | | | |
|---|---|---|---|---|
| 5,651,734 | A * | 7/1997 | Morris | E04D 1/36 454/365 |
| 5,934,995 | A * | 8/1999 | Morris | E04D 1/36 454/365 |
| 5,947,817 | A * | 9/1999 | Morris | E04D 1/36 454/365 |
| 6,450,882 | B1 * | 9/2002 | Morris | E04D 13/176 454/365 |
| 2007/0011957 | A1 * | 1/2007 | Willert | E04D 13/152 52/95 |
| 2007/0117505 | A1 * | 5/2007 | Wey | E04D 13/176 454/366 |
| 2010/0043312 | A1 * | 2/2010 | Chich | E04D 13/152 52/95 |

(Continued)

*Primary Examiner* — Jessica Laux
(74) *Attorney, Agent, or Firm* — Justin Lampel

(57) ABSTRACT

A construction system for releasing moisture from a building is provided. The system is especially suitable for use in buildings having a hip, valley or gable roof. More specifically, the device gives the hip, valley or gable roof adequate ventilation and moisture vapor release portals so as to allow air and water vapor to properly rise through the interior of the hip, valley or gable roof and out through ridge vents without becoming trapped by rafters of the hip, valley or gable roof. The system has a first unit and a second unit, wherein the first unit allows air and water vapor to pass through passageways of the first unit up through the underside of the hip, valley or gable roof up and out through the ridge vent(s) and the second unit allows air from the exterior to pass into the roof cavity to circulate through the roof cavity and into the first unit.

5 Claims, 7 Drawing Sheets

(56) References Cited

U.S. PATENT DOCUMENTS

2012/0047831 A1* 3/2012 Polumbus ..... E04D 13/172
52/302.1

2014/0099877 A1* 4/2014 Gassman ..... E04D 13/178
454/366

* cited by examiner

FIG. 1
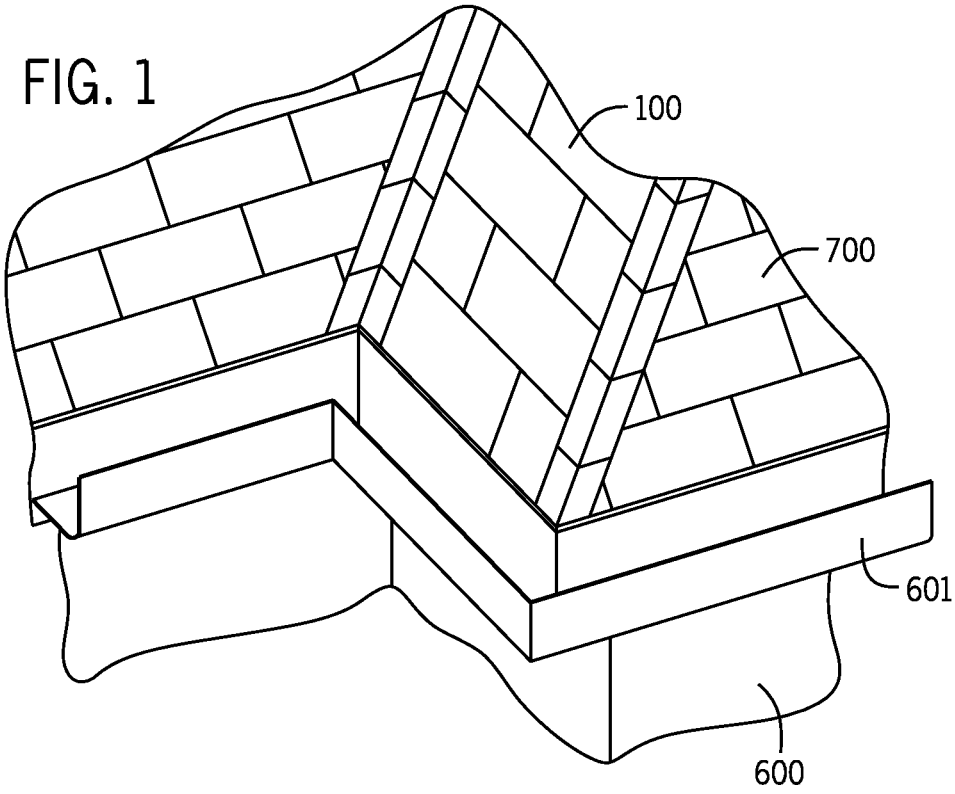
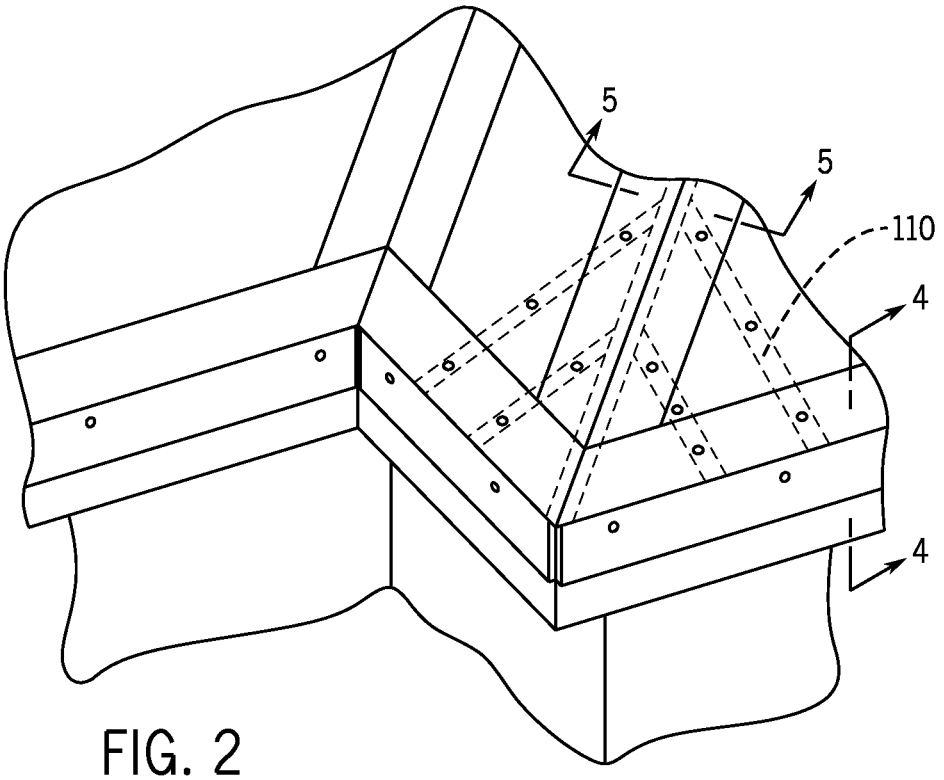
FIG. 2

FIG. 6
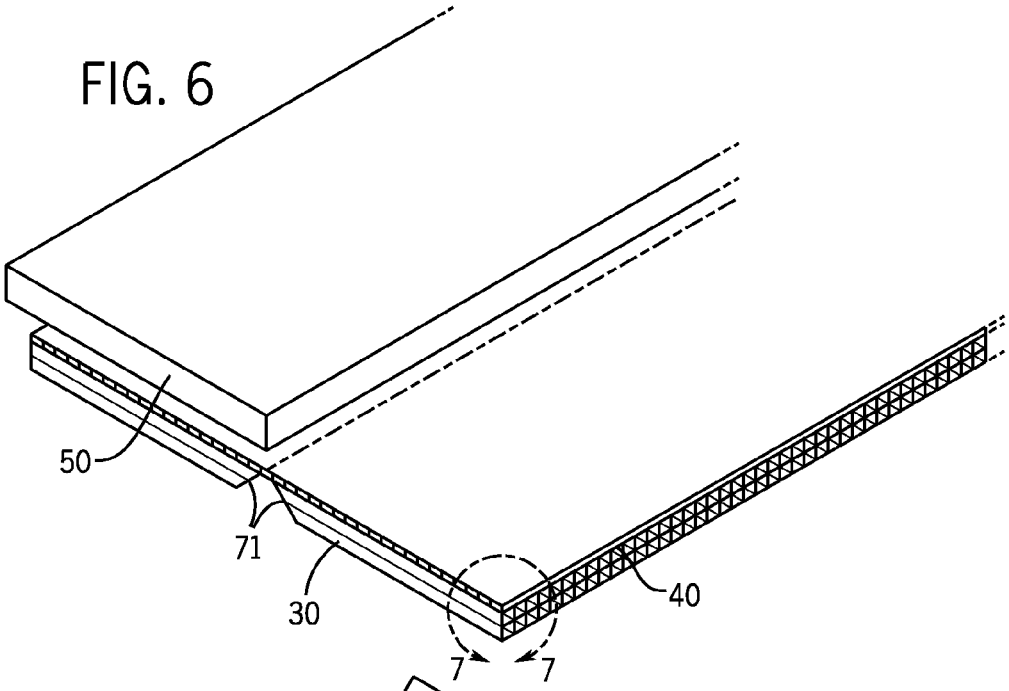
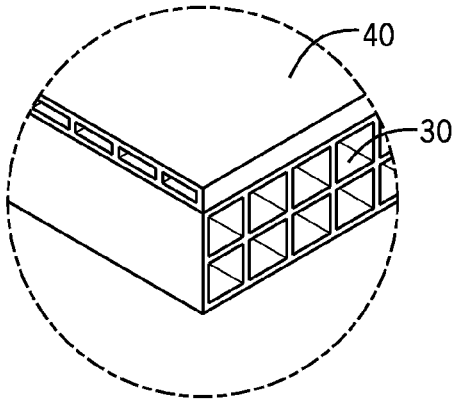
FIG. 7
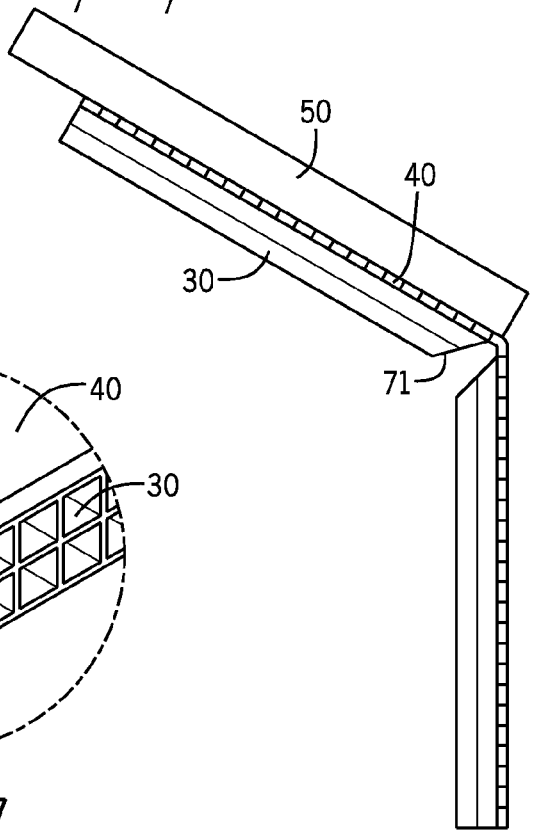
FIG. 8

FIG. 9
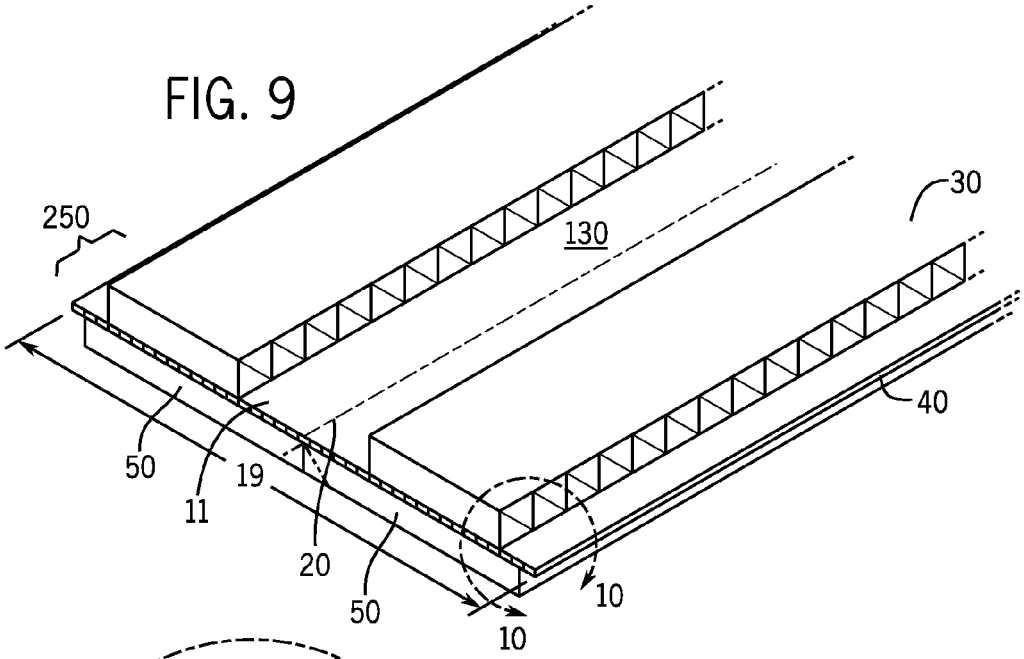
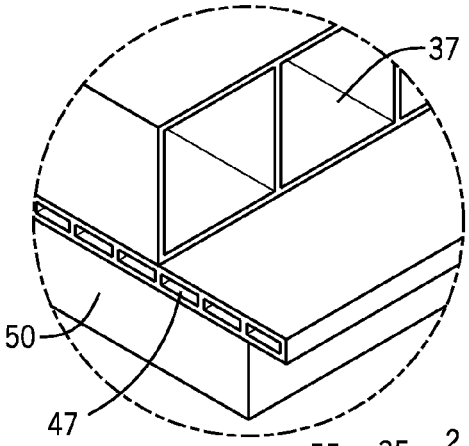
FIG. 10
FIG. 11
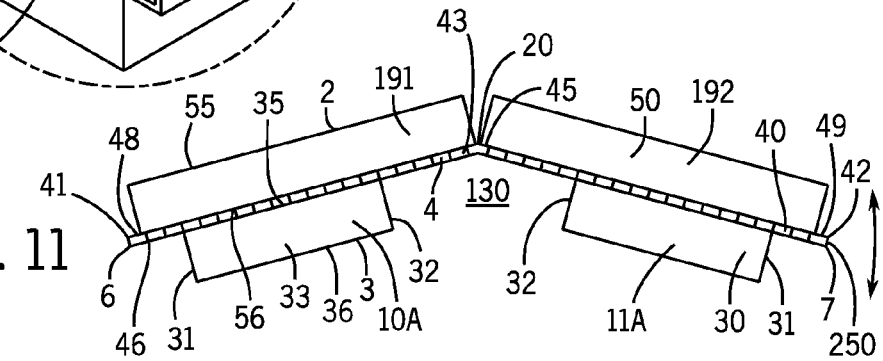
FIG. 12
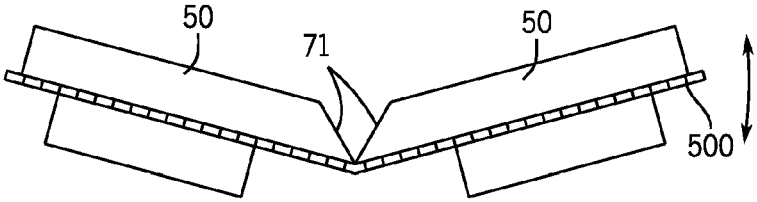

CONSTRUCTION SYSTEM FOR RELEASING MOISTURE FROM A HIP, VALLEY OR GABLE ROOF

CROSS REFERENCE TO RELATED APPLICATIONS

The following application is a divisional application of U.S. Ser. No. 14/248,677, currently co-pending, and claims the priority benefit of the '677 U.S. application; the entire contents of which are incorporated by reference.

BACKGROUND OF THE INVENTION

A construction system for releasing moisture from a building is provided. The system is especially suitable for use in buildings having a hip, valley or gable roof. More specifically, the device gives the hip, valley or gable roof adequate ventilation and moisture vapor release portals so as to allow air and water vapor to properly rise through the interior of the hip, valley or gable roof and out through ridge vents without becoming trapped by rafters of the hip, valley or gable roof. The system has a first unit and a second unit, wherein the first unit allows air and water vapor to pass through passageways of the first unit up through the underside of the hip, valley or gable roof up and out through the ridge vent(s) and the second unit allows air from the exterior to pass into the roof cavity to circulate through the roof cavity and into the first unit.

Attempts have been made to provide construction devices that release moisture vapor from buildings. For example, U.S. Pat. No. 8,635,822 to Walker discloses a ventilated structural panel comprising a first sheet, having edges that define a horizontal axis with a first horizontal edge and a second horizontal edge, and vertical axis with a first vertical edge and a second vertical edge, a second sheet being of substantially the same planar dimensions as the first sheet and having edges that define a horizontal axis and vertical axis, with a first horizontal edge and a second horizontal edge and a first vertical edge and a second vertical edge, the first and the second sheet being parallel in plane and matched in at least one of the vertical axis and the horizontal axis, a plurality of spacing structural elements, formed integrally with at least one of the first and the second sheet, fixedly attaching the first sheet to the second sheet, such that the yield strength of the combined panel is greater than the combined individual yield strengths of the first and the second sheet; and the plurality of spacing structural elements being arranged such that a plurality of unobstructed pathways are created for air to move from at least one edge of the panel to at least one of an opposite and an adjacent edge of the panel, and being arranged to provide integral ventilation through the materials and between the first and the second sheet.

U.S. Pat. No. 8,468,750 to Clearfiled discloses a seal for a flashing joint on an open frame structure using a first barrier sheet having first and second adhesive strips on opposing primary surfaces proximate to opposing edges and running the length of the first barrier sheet by applying the first barrier sheet over the flashing joint with one edge below the flashing joint and adhering an adhesive strip to a building element below the flashing joint with the first adhesive strip and applying a second barrier sheet overlapping the first barrier sheet and adhere the first and second barrier sheets together using the second adhesive strip. The process can include applying flashing over the first barrier sheet and flashing joint and then overlaying the flashing with the second barrier sheet and sealing the second barrier sheet to both the first barrier sheet and the flashing.

Further, U.S. Pat. No. 6,886,301 to Schilger discloses a building construction device for exterior building walls. The construction comprises an interior frame formed of a plurality of laterally spaced studs or beams, a layer of rigid insulation adjacent to the exterior side of this steel frame, exterior building cladding adjacent the exterior side of the rigid insulation and a plurality of low conductivity connectors, e.g. insulating plastic connectors or thin metal strips having an insulating plastic foam coating, extending through the layer of rigid insulation and connecting together the exterior cladding and the interior steel studs or beams. Vertical channels are formed adjacent both the inside and outside faces of the insulation layer to remove moisture. This provides the required structural strength with a minimum of thermal conductivity from the warm side to the cold side of the building envelope, while providing exterior drain channels and interior moisture removing channels.

Further, U.S. Pat. No. 8,635,822 to Walker discloses a ventilated structural panel comprising a first sheet, having edges that define a horizontal axis with a first horizontal edge and a second horizontal edge, and vertical axis with a first vertical edge and a second vertical edge, a second sheet being of substantially the same planar dimensions as the first sheet and having edges that define a horizontal axis and vertical axis, with a first horizontal edge and a second horizontal edge and a first vertical edge and a second vertical edge, the first and the second sheet being parallel in plane and matched in at least one of the vertical axis and the horizontal axis, a plurality of spacing structural elements, formed integrally with at least one of the first and the second sheet, fixedly attaching the first sheet to the second sheet, such that the yield strength of the combined panel is greater than the combined individual yield strengths of the first and the second sheet; and the plurality of spacing structural elements being arranged such that a plurality of unobstructed pathways are created for air to move from at least one edge of the panel to at least one of an opposite and an adjacent edge of the panel, and being arranged to provide integral ventilation through the materials and between the first and the second sheet.

However, these patents fail to provide a device for properly releasing moisture and water vapor from the hip, valley or gable roof of a building as described in the present application. A need, therefore, exists for an improved device for releasing moisture and water vapor from a hip, valley or gable roof of a building that has the features of the present invention.

SUMMARY OF THE INVENTION

A construction system for releasing moisture from a building is provided. The system is especially suitable for use in buildings having a hip, valley or gable roof. More specifically, the device gives the hip, valley or gable roof adequate ventilation and moisture vapor release portals so as to allow air and water vapor to properly rise through the interior of the hip, valley or gable roof and out through ridge vents without becoming trapped by rafters of the hip, valley or gable roof. The system has a first unit and a second unit, wherein the first unit allows air and water vapor to pass through passageways of the first unit up through the underside of the hip, valley or gable roof up and out through the ridge vent(s) and the second unit allows air from the exterior to pass into the roof cavity to circulate through the roof cavity and into the first unit.

An advantage of the present device is that the present device allows moisture to circulate within and easily escape from a hip, valley or gable roof of a building.

Yet another advantage of the present device is that the present device prevents condensation from forming in a hip, valley or gable roof of a building or remaining in the wall of the building.

And an advantage of the present device is that the openings of the vented support housing may be at an angle so as to allow air flow through the openings to rise up through the interior of the roof in a generally direct line.

Still another advantage of the present device is that the device includes a "substrate layer" which provides a uniform surface to which roofing materials easily and efficiently adhere to the rafters of a building.

Still another advantage of the present device is that the device includes a corrugated plastic support layer (or "substrate layer") which provides a uniform surface to which roofing materials easily and efficiently adhere to the rafters of a building.

Still another advantage of the present device is that the present device provides a passage which allows air and moisture to properly move through a hip, valley or gable roof.

And another advantage of the present device is to provide a device which reduces mold and moisture damage in a building which is easy to install.

For a more complete understanding of the above listed features and advantages of the moisture releasing construction device reference should be made to the following detailed description of the preferred embodiments and to the accompanying drawings. Further, additional features and advantages of the present invention are described in, and will be apparent from, the detailed description of the preferred embodiments and from the drawings.

BRIEF DESCRIPTION OF THE DRAWINGS

FIG. 1 illustrates a front perspective view of the device as inserted under shingles on a roof and behind a gutter of a building.

FIG. 2 illustrates a partially see through view of the device installed in a roof.

FIG. 6 illustrates a view of the second unit in a flat configuration, uninstalled in a roof.

FIG. 7 illustrates a detailed view of FIG. 6.

FIG. 8 illustrates a side view of the second unit wherein the first panel and the second panel are at an angle with respect to each other as applied to a roof perimeter.

FIG. 9 illustrates a view of the bottom of the first unit.

FIG. 10 illustrates a detailed view of FIG. 9.

FIG. 11 illustrates a side view of the first unit as applied in a hip construction.

FIG. 12 illustrates a side view of the first unit as applied in a valley construction.

DETAILED DESCRIPTION OF THE PREFERRED EMBODIMENTS

A construction system for releasing moisture from a building is provided. The system is especially suitable for use in buildings having a hip, valley or gable roof. More specifically, the device gives the hip, valley or gable roof adequate ventilation and moisture vapor release portals so as to allow air and water vapor to properly rise through the interior of the hip, valley or gable roof and out through ridge vents without becoming trapped by rafters of the hip, valley or gable roof. The system has a first unit and a second unit, wherein the first unit allows air and water vapor to pass through passageways of the first unit up through the underside of the hip, valley or gable roof up and out through the ridge vent(s) and the second unit allows air from the exterior to pass into the roof cavity to circulate through the roof cavity and into the first unit.

Figure 4:
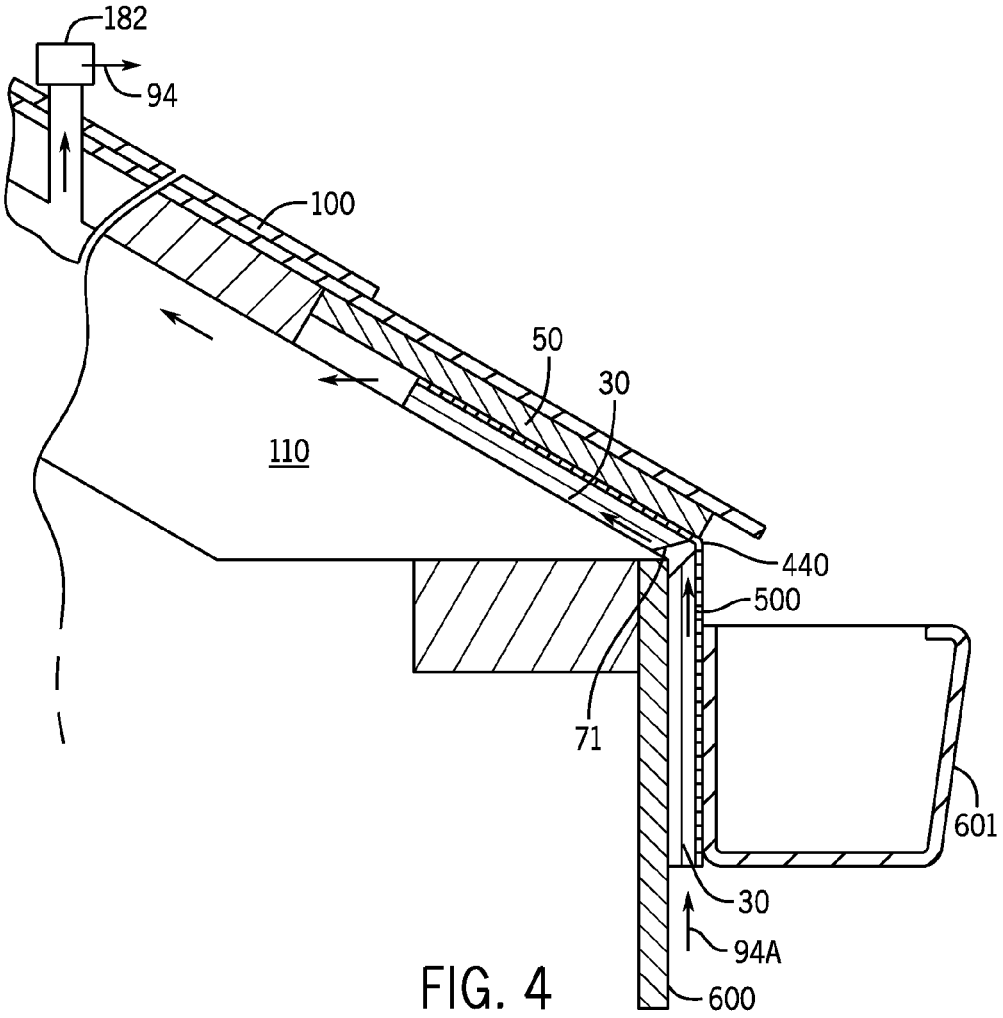
FIG. 4 illustrates a side cut-away view of the second unit installed on a roof.

Referring now to the figures, a moisture release device 1 (FIG. 9) is provided. The moisture release device 1 is especially suitable for allowing moisture to escape a hip, valley or gable roof of a building. The moisture release device 1 may have a first unit 250 (FIG. 9) and a second element 500 (FIG. 4). The first unit 250 and the second unit 500 may be substantially similar except that the second unit 500 may lack a portion of a roof layer 50 and may lack a space 130 (found on FIG. 11) between a first panel 10 and a second panel 11 of a vented support housing 30 as described below. In an embodiment, the first unit 250 or the second unit 500 may be used in different locations on a hip, valley or gable roof. Further, in an embodiment, a user may elect to only use one of the first unit 250 or the second unit 500 in connection with the roof of a building.

Referring now to FIGS. 11 and 12, the first unit 250 may be multi-layered having a top 2, a bottom 3, a front 4, a back, a first side 6 and a second side 7. In an embodiment, the first unit 250 has a first panel 10A and a second panel 11A. The first panel 10 may be generally identical to the second panel 11 and may be attached to the second panel 11 at a crease or self-hinge 20. More specifically, the first panel 10 may rotate with respect to the second panel 11 at the crease or self-hinge 20. Preferably, the first panel 10 may rotate approximately one hundred and eighty degrees with respect to the second panel 11. In an embodiment, the total length 19 of the first unit 250 (equal to the length of the first panel 10 and the second panel 11 combined) may be approximately eight feet in length. It should be understood that this length 19 (FIG. 9) may be altered depending on the desired application of the first unit 250.

In an embodiment, the first panel 10 and the second panel 11 of the first unit 250 may each have a plurality of layers. More specifically, both the first panel 10 and the second panel 11 may each have a vented support housing 30, a connecting support 40 and a roof layer 50. The vented support housing 30 may be, for example, a 4 mm corrugated plastic layer, a 10 mm corrugated plastic layer or the like. The vented support housing 30 of both the first panel 10 and the second panel 11 may each have a first side 31 (FIG. 11), a second side 32, a front 33, a back (not shown), a top 35 and a bottom 36. The vented support housing 30 may be located directly below the connecting support 40 such that the top 35 of the vented support housing 30 may be in direct contact with and secured to the bottom 46 of the connecting support 40 (as described below). In an embodiment, a securing mechanism, such as a waterproof, permanent spray adhesive, may permanently secure the top 35 of the vented support housing 30 to the bottom 46 of the connecting support 40. In an embodiment, the first panel 10 and the second panel 11 of the vented support housing 30 may be separated by a space 130 wherein the crease or self-hinge 20 is located within the space 130.

In an embodiment, the vented support housing 30 may have a plurality of openings 37 (FIG. 10) creating a hollow passageway. More specifically, in an embodiment, the plurality of openings 37 may run generally parallel to the front 4 of the vented support housing 30. The plurality of openings 37 may extend through the entire length of the first panel 10 and the second panel 11 of each of the vented support housing 30 units; from the first side 31 to the second side 32 of each. In an embodiment, the plurality of openings 37 may be generally square in shape so as to better support the connecting support 40 located directly above the vented support housing units 30. Further, in an embodiment, the plurality of openings 37 may have more than one layer (not shown).

As stated above, in an embodiment, the vented support housing 30 may have a first panel section 10 and a second panel section 11. Preferably, the first panel section 10 and the second panel section 11 may be approximately equal in size. Further, the first panel section 10 and the second panel section 11 may be separated by the crease or self-hinge 20.

The connecting support 40 may have a first side 41, a second side 42, a front 43, a back (not shown), a top 45 and a bottom 46. In an embodiment, the connecting support 40 may be a corrugated plastic layer. Preferably, the corrugated plastic layer of the connecting support 40 is a 2 mm corrugated plastic layer. The smaller size of the corrugated plastic layer of the connecting support 40 compared to the larger corrugated plastic layer of the vented support housing 30 further helps to reduce the chances of insects gaining access into the building. In an embodiment, the connecting support 40 may have a plurality of openings 47 (FIG. 10) creating a passageway which may extend through the entire length of the first side 41 and the second side 42 of the connecting support 40. Unlike the vented support housing 30, the connecting support 40 may be a single connected unit.

In an embodiment, the plurality of the openings 47 of the connecting support 40 may run generally perpendicular to the plurality of openings 37 of the vented support housing 30. As a result of the plurality of openings 47 of the connecting support 40 running generally parallel to the first side 6 and the second side 7 of the first unit 250 and as a result of the smaller openings 47 of the connecting support 40, the connecting support 40 may be bent along one of the openings 47 of the connecting support 40 and may allow the connecting support 40 to bent in two units; forming a first section 48 (FIG. 11) and a second section 49.

The roof layer 50 may have a first panel 191 (FIG. 11) and a second panel 192 each having a top 55 and a bottom 56. In an embodiment, the roof layer 50 may be made of wood. Further, in an embodiment, the bottom 56 of the roof layer 50 may be in direct contact with and secured to the top 45 of the connecting support 40. Preferably, the bottom 56 of the roof layer 50 may be secured to the top 45 of the connecting support 40 by, for example, waterproof, permanent spray adhesive.

In an embodiment, the first panel 191 of the roof layer 50 may move with respect to the second panel 192 of the roof layer 50. In an embodiment, the first panel 191 of the roof layer 50 may be generally larger than the vented support housing 30 of the first panel 10 and the second panel 192 of the roof layer 50 may be generally larger than the vented support housing 30 of the second panel 11. In particular, the roof layer 50 may substantially cover almost the entire top 45 of the connecting support 40 whereas the vented support housing 30 does not cover substantially the entire bottom 46 of the connecting support 40 as a result of the space 130 between the vented support housing 30 units and a space between the first side 31 of the vented support housing 30 and the first side 41 of the connecting support 40.

In an embodiment, when used on a valley, the side of the first panel 191 of the roof layer 50 closest to the crease or self-hinge 20 and the side of the second panel 192 of the roof layer 50 closest to the crease or self-hinge 20 may have a tapered edge 71 (FIG. 12). The tapered edge 71 of the side of the first panel 191 closest to the crease 20 and the tapered edge 71 of the second panel 192 closest to the crease 20 may allow the first panel 191 of the roof layer 50 and the second panel 192 of the roof layer 50 to rotate upward toward each other without the edges of the first panel 191 and the second panel 192 contacting each other; or may allow the first panel 191 and the second panel 192 to rotate away from each other without the top of the roof having an unnatural ridge above the crease or self-hinge section 20.

Figure 5:
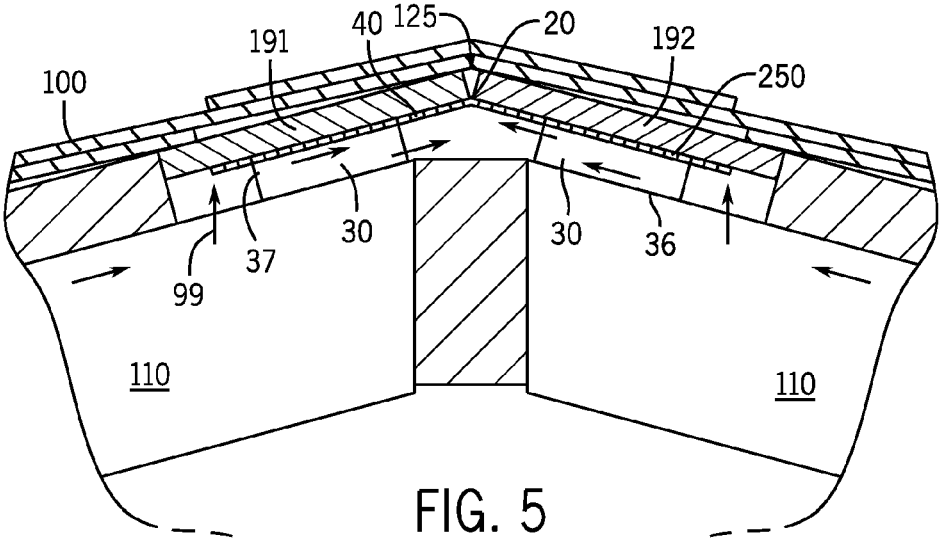
FIG. 5 illustrates cut-away side view of the first unit installed in a roof.

Referring now to FIG. 5, the first unit 250 may be used in connection with a hip roof 100. In particular, the crease 20 of the first unit 250 may be used to replace the joint of a normal hip roof 100. In use, a strip of the hip roof 100 (equal to the total length 19 of the first unit 250) may be first removed from the roof 100 by means of a saw. The bottom 36 of the vented support housing 30 may then be permanently secured to rafters 110 of the hip roof 100. In particular, the vented support housing 30 may directly contact and be secured to the rafters 110 of the hip roof 100 every eighteen inches on average (or however far apart the rafters 110 are placed). Preferably, the first unit 250 is secured to the rafters 110 by nails. Further, the bottom 36 of the vented support housing 30 may be the only portion of the first unit 250 to contact to the rafters 110.

In an embodiment, the overall height of the first unit 250 (including the vented support housing 30, the connecting support 40 and the roof layer 50 together) may be generally similar to the thickness of the wood removed from the hip roof 100. Alternatively, the overall height of the first unit 250 may be generally greater than the height of the wood removed from the hip roof 100 such that the first unit 250, when installed, causes the hip 100 to have an elevated portion along the length of the first unit 1.

Figure 13:
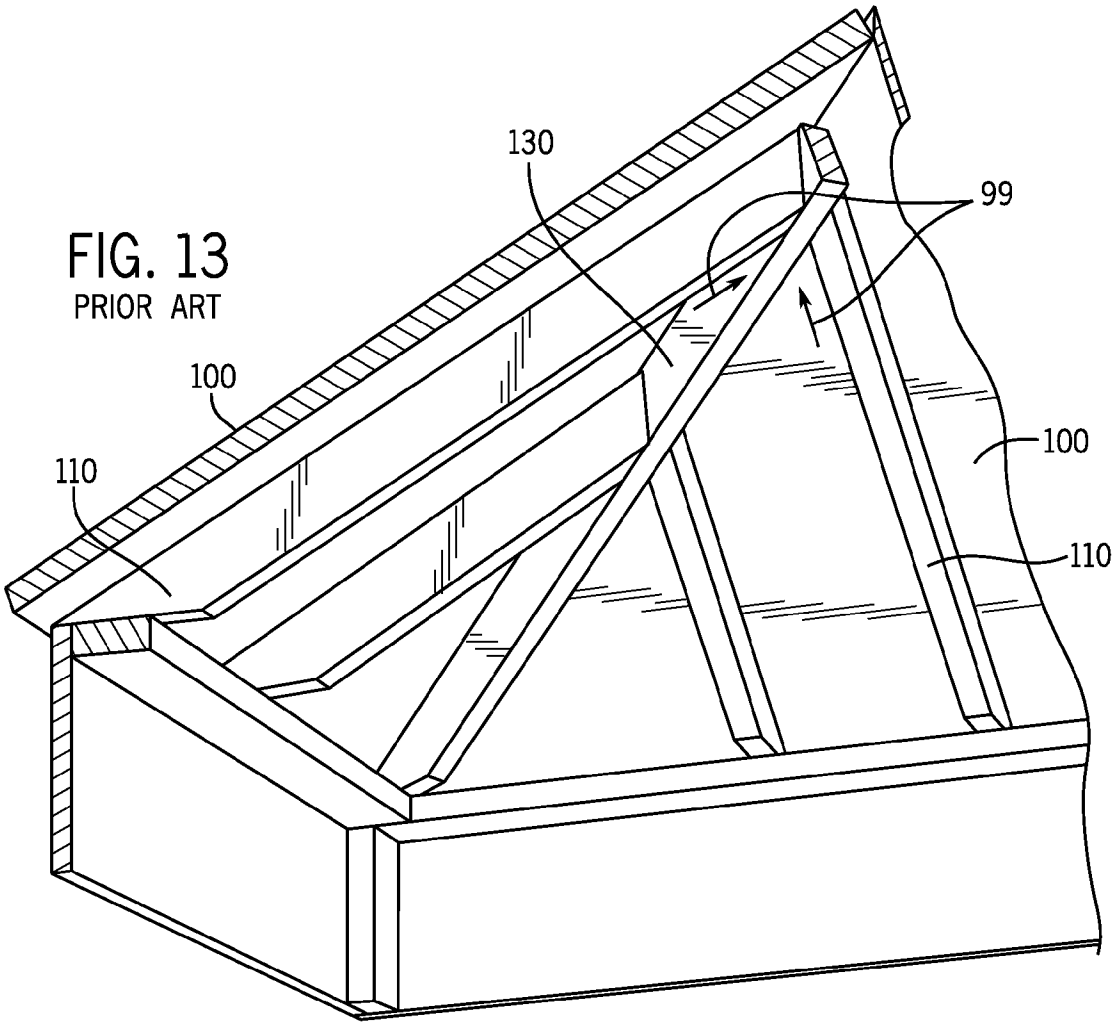
FIG. 13 PRIOR ART
FIG. 13 illustrates a view of the Prior Art of a normal roof allowing air to be trapped by the rafters.
Figure 14:
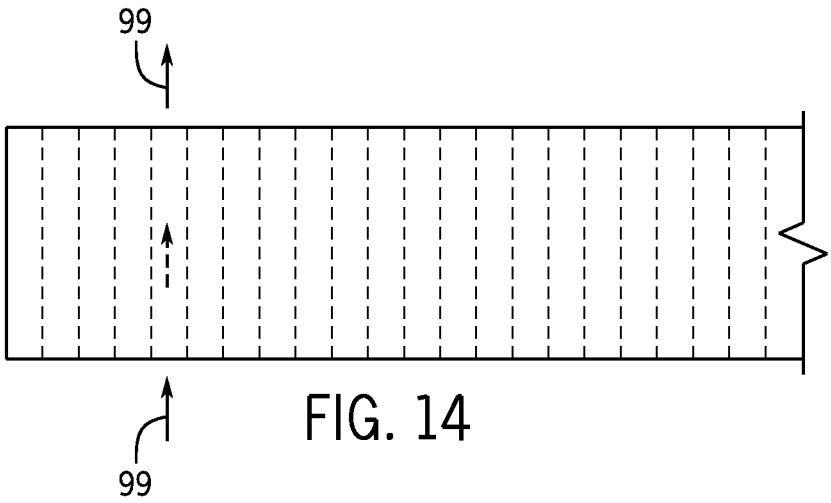
FIG. 14 illustrates the openings of the corrugated vented support housing running parallel to the front of the vented support housing so that air flow through the openings runs parallel to the front of the vented support housing.

During use, the plurality of openings 37 of the vented support housing 30 may face the center point 125 of the hip roof 100. As a result, air and moisture 99 which travels through the passageway of the plurality of the openings 37 may rise to the center point 125 of the gable roof 100 and ridge vent(s). As a result of the space 130 between the first panel 10 and the second panel 11 of the vented support housing 30, the air and moisture 99 may rise up the length of the hip roof 100 through the space 130 toward the top of the gable roof 100 and ridge vent(s) wherein the air and moisture 99 may then exit the gable roof 100 through a vent 182 (FIG. 4). In gable roofs lacking the first unit 250, the air and moisture 99 would get trapped by between the rafters 110 and cannot rise up and out of the roof efficiently, as is illustrated in the Prior Art of FIG. 13.

In an embodiment, a second unit device 500 (FIG. 4) may be used in connection with the first unit 250. The second device 500 may have a first panel 10 and a second panel 11 separated at a crease 440. In an embodiment, the first panel 10 may have a vented support housing 30, a connecting support 40 and a roof layer 50 similar to the first unit 250 (FIG. 1). However, the second panel 11 of the second unit 500 may lack the roof layer 50 such that the top portion of the second panel 11 is the top 45 of the connecting support 40. As in the first unit 250, the vented support housing 30 of the first panel 10 may be a 4 mm corrugated plastic layer and the roof layer 50 may be made of wood.

Figure 3:
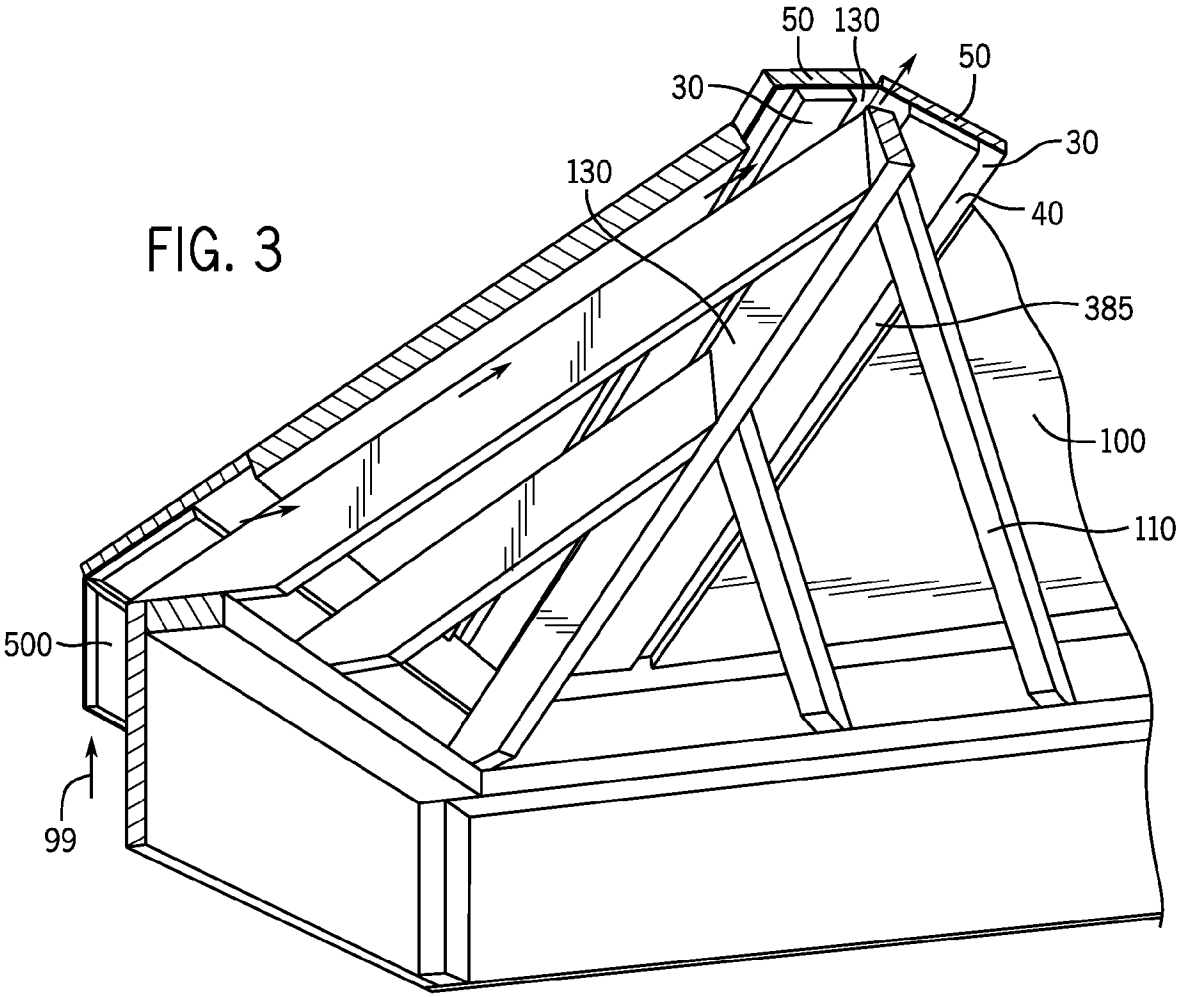
FIG. 3 illustrates a view of the underside of a roof with the both units of the device installed therein.

Referring now to FIG. 3, the first unit 250 is illustrated. A space 385 may exist between the vented support housing 30 of the first unit 250 and the wood of the roof 100. This space 385 allows air and moisture 99 to flow from the lower interior part of the attic upward along the interior surface of the roof 100 and out to the ridge vent(s) 182. More specifically, the air or moisture 99 may move from the space 385, through the vented support housing 30, to the space 130 between the two vented support housings 30 and up along the interior surface of the roof out to the ridge vent(s) 182.

Referring now to FIG. 4, in use, the second panel 11 of the second unit 500 may be located between an exterior fascia 600 of the building and the gutter 601 of the building. The first panel 10 of the second unit device 500 may have a plurality of openings 37 similar to the opening 37 of the first unit device 250. The openings 37 may allow air 94A to pass first through the second panel 11 of the second unit device 500 to the first panel 10 of the second unit device 500 and into the interior of the roof 100 of the building. In an embodiment, the vented support housing 30 of the first panel 10 and the second panel 11 may extend almost all the way to the crease 440 of the second unit 500.

Further, the inward edges of the vented support housing 30 of the first panel 10 and the second panel 11 may be tapered 71 so as to allow the first panel 10 and the second panel 11 of the second unit 500 to rotate downward toward each other at the crease 440.

In an embodiment, while the first unit 250 runs along the center of all the hip roof surfaces, the second unit device 500 may run along the perimeter of the building behind the gutters 601 of the building. Once the first unit device 250 and the second unit device 500 are properly installed on a building, the first unit device 250 and second unit device 500 may be properly covered by a waterproof seal and then the shingles 700 (FIG. 1) of the hip roof 100. In an embodiment, the second unit 500 may be partially covered by shingles and partially covered by the gutter 601.

Once within the interior of the roof 100 of the building, the device 1 allows air 99 to circulate and may help evaporate or dry existing moisture 99A so that air 99 may circulate throughout the space between the rafters 110 and then with collected moisture vapor may pass up through the openings 37 of the second unit device 500, then through the first unit device 250, and then up through the space 130 of the first unit device 250 and out to the ridge vent(s) 182. As a result, trapped air and moisture 99 may circulate through the interior roof 100 of the building without becoming stagnant or absorbing into the wood roof structures. Mold and water damage may therein be eliminated or greatly reduced.

Referring now to FIG. 1, the system may also be used in a valley roof. More specifically, in a valley roof, the crease or self-hinge 20 may allow the two vented support housings 30 to bend upward, forming a "v-shape" with respect to the ground so that the crease or self-hinge 20 is closer to the ground than the vented support housings 30 and other elements. The space 385 between the exterior side (the side farthest away from the crease 20) of the vented support housings 30 and the space 130 between the two vented support housings 30 may also allow the air or moisture 99 to travel up the interior side of the roof and out to the ridge vent (s) 182.

Figure 15:
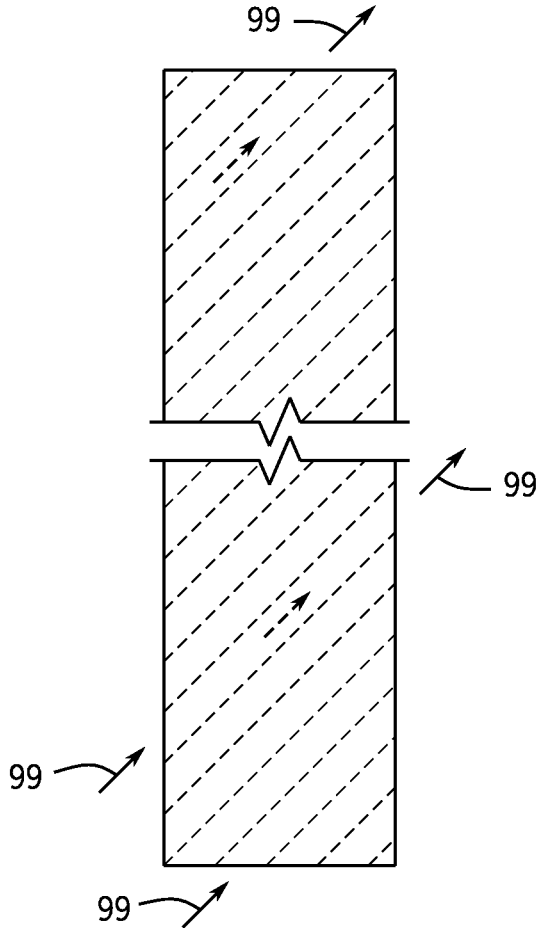
FIG. 15 illustrates the openings of the corrugated vented support housing running at an angle to the front of the vented support housing so that air flowing through the vented support housing more easily travels up the interior of the roof.

Referring now to FIG. 15, in an embodiment, the openings 37 of the vented support housing 30 may not run parallel to the front 33 of the vented support housing 30. In particular, the openings 37 of the vented support housing 30 may run at an angle (FIG. 15 illustrates the openings 37 running at approximately forty-five degrees) so that air 99 which flows through the openings 37 may flow upward in a more direct manner as it rises up the interior of the roof and out through the vent 182.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A moisture releasing system for a roof comprising:

a first panel having a first layer, a second layer and a third layer wherein the second layer is located between the first layer and third layer;

wherein the first layer of the first panel has a first side, a second side, a front, a back, a top and a bottom and a plurality of openings creating a hollow channel which runs from the first side of the first panel to the second side of the first panel;

wherein the bottom of the first layer of the first panel is in contact with and secured to a rafter of said roof and wherein the third layer of the first panel is secured under said roof;

a hollow space located between the first side of the first layer and a panel of wood of the roof wherein the panel of wood is also secured to the rafter;

wherein moist air flows through the hollow space between the first side of the first layer and the panel of wood of the roof and then through the hollow channel of the first layer to the second side of the first layer and then up and out of a vent of the roof; and wherein the second side of the first layer of the first panel is tapered and wherein the first side of the first layer of the first panel is not tapered and wherein the second side of the first layer of the first panel is located between the first of the first layer of the first panel and a second panel which is connected to the first panel.

2. A moisture releasing system for a roof comprising:

a first panel having a first layer, a second layer and a third layer wherein the second layer is located between the first layer and third layer;

wherein the first layer of the first panel has a first side, a second side, a front, a back, a top and a bottom and a plurality of openings creating a hollow channel which runs from the first side of the first panel to the second side of the first panel;

wherein the bottom of the first layer of the first panel is in contact with and secured to a rafter of said roof and wherein the third layer of the first panel is secured under said roof;

a hollow space located between the first side of the first layer and a panel of wood of the roof wherein the panel of wood is also secured to the rafter;

wherein moist air flows through the hollow space between the first side of the first layer and the panel of wood of the roof and then through the hollow channel of the first layer to the second side of the first layer and then up and out of a vent of the roof;

a second panel having only a first layer and a second layer wherein the second layer of the second panel is located above the first layer of the second panel;

wherein the second layer of the first panel is secured to the second layer of the second panel; and wherein the second side of the first layer of the first panel is tapered and wherein the first side of the first layer of the first panel is not tapered.

3. The moisture releasing system for a roof of claim 2 wherein the second panel is secured between a gutter of a building and a side of the building and wherein the first panel is partially secured under the roof.

4. The moisture releasing system for a roof of claim 2 wherein a second side of the first layer of the second panel is tapered and wherein a first side of the first layer of the second panel is not tapered.

5. The moisture releasing system for a roof of claim 4 wherein the taper of the second side of the first layer of the first panel is adjacent to the taper of the second side of the first layer of the second panel.

* * * * *